US007599511B2

(12) United States Patent
Corynen

(10) Patent No.: US 7,599,511 B2
(45) Date of Patent: Oct. 6, 2009

(54) LOUDSPEAKER WITH UNDULATED MEMBRANE

(75) Inventor: David Magda Eddy Corynen, Dendermonde (BE)

(73) Assignee: PSS Belgium N.V., Dendermonde (BE)

( * ) Notice: Subject to any disclaimer, the term of this patent is extended or adjusted under 35 U.S.C. 154(b) by 257 days.

(21) Appl. No.: 10/567,400

(22) PCT Filed: Aug. 3, 2004

(86) PCT No.: PCT/IB2004/051371

§ 371 (c)(1),
(2), (4) Date: Jan. 17, 2007

(87) PCT Pub. No.: WO2005/015950

PCT Pub. Date: Feb. 17, 2005

(65) Prior Publication Data

US 2007/0189571 A1 Aug. 16, 2007

(30) Foreign Application Priority Data

Aug. 8, 2003 (EP) ..... 03102482
Feb. 9, 2004 (EP) ..... 04100460

(51) Int. Cl.
*H04R 7/02* (2006.01)
*H04R 9/06* (2006.01)

(52) U.S. Cl. ..... 381/423; 381/398; 381/404

(58) Field of Classification Search ..... 381/150, 381/398, 404, 423, 424; 181/157, 164, 173
See application file for complete search history.

(56) References Cited

U.S. PATENT DOCUMENTS 6,236,733 B1 * 5/2001 Kato et al. ..... 381/423

FOREIGN PATENT DOCUMENTS

JP 60171897 A * 9/1985

OTHER PUBLICATIONS

Maruno, Yoshiaki, "Diaphragm For Speaker", Abstract Translation, Sep. 5, 1985, pp. 1 and 2.*

* cited by examiner

*Primary Examiner*—Brian Ensey
(74) *Attorney, Agent, or Firm*—Sheehan Phinney Bass & Green, PA; Peter A. Nieves

(57) ABSTRACT

A loudspeaker provided with a frame (101), a membrane (103) and a drive unit (105). The membrane has an outer circumferential edge (104*a*) suspended from the frame and an inner circumferential edge (104*b*). The drive unit has a stationary part (106*a*) secured to the frame and a translatable part (106*b*) provided with a coil support (108*b*) secured to the inner circumferential edge of the membrane. The membrane includes a membrane body (104) which, viewed in a circumferential direction, has a pattern of folds radially extending between the inner circumferential edge and the flat outer circumferential edge of the membrane. The folds have a depth (d), which increases from the edges (104*a*, 104*b*) towards an area (104A) situated between both edges. In this area, the folds are provided with faces (204C), to which a spider (111) of the loudspeaker is secured. This loudspeaker combines a small height with a large stroke of the membrane.

9 Claims, 3 Drawing Sheets

LOUDSPEAKER WITH UNDULATED MEMBRANE

FIELD OF THE INVENTION

The invention relates to a loudspeaker which is provided with a frame, a membrane and a drive unit.

BACKGROUND OF THE INVENTION

Such speakers are generally known. FIG. 8 of the accompanying drawing shows a known loudspeaker. This speaker has a frame (1), a membrane (2) and an electromagnetic drive unit (4). The membrane is formed by a conical body (2*a*) and has a flat outer circumferential edge (2*b*) and a flat inner circumferential edge (2*c*). The drive unit is provided with a stationary part (4*a*) and a movable part (4*b*). The stationary part, which includes a permanent magnet and a magnetic yoke, is secured to the frame. The movable part includes a voice coil and a cylindrical coil support (4*b*1). At its outer circumferential edge, the membrane is connected to the frame by means of a flexible suspension (6) and at its inner circumferential edge, it is adhered to the coil support, which in its turn is connected to the frame by means of a spider (8).

The conventional conical body of the membrane of the depicted known loudspeaker has a certain height in order to obtain sufficient stiffness. The membrane should have a certain minimal stiffness in order to be able to move like a piston for low-frequency reproduction and to have a controlled behavior at and above the first break-up of the membrane for mid and high-frequency reproduction. For this reason, there arise problems relating to the speaker's performance if a shallow speaker, i.e. a speaker having a small height, is required in certain applications.

JP-A 54-6523 discloses a shallow speaker, which is provided with a faintly conical diaphragm having a corrugation structure for improving the behavior of the diaphragm. The diaphragm has an outer circumferential part glued to an elastic suspension ring and an inner circumferential part glued to a voice-coil bobbin. The corrugation structure is formed by radial corrugations which decrease towards the outer circumferential part and increase towards the inner circumferential part. Due to this structure, the outer circumferential part includes a flat ring-shaped outer edge glued to the suspension ring, and the inner circumferential part includes an undulating inner edge glued to the bobbin. The speaker is further provided with a spider secured to the voice-coil bobbin.

Although the speaker known from JP-A 54-6523 comprises means for solving the problem relating to lack of stiffness of a faintly conical diaphragm, it causes another problem, viz. a problem relating to the instability of the diaphragm movements due to the small axial distance between the suspension means formed by the suspension ring and the spider.

SUMMARY OF THE INVENTION

It is an object of the invention to provide a loudspeaker which can be given a small height without deteriorating its sound performance and with stable membrane movements during use.

This object is achieved with the loudspeaker according to the invention, which is provided with a frame, a membrane and a drive unit, the membrane having an outer circumferential edge suspended from the frame and an inner circumferential edge, the drive unit having a stationary part secured to the frame and a translatable part secured to the inner circumferential edge of the membrane, wherein the membrane includes a membrane body which, viewed in a circumferential direction, has a pattern of folds radially extending between the inner circumferential edge and the outer circumferential edge of the membrane, which folds, viewed from the membrane body towards the drive unit in a direction substantially perpendicular to the membrane, have a depth which increases from said edges towards an area situated between the inner circumferential edge and the outer circumferential edge, in which area the folds are provided with faces, wherein a suspension means is provided which is secured to the frame and said faces.

The loudspeaker according to the invention is provided with a membrane body which is undulated in such a way that fold portions are provided in said area which are suitable for fixing the suspension means, such as a spider known per se. These integrated fold portions are situated at a considerable axial distance, i.e. the distance viewed along a movement direction of the membrane, to the suspended outer circumferential edge of the membrane. In this way, the loudspeaker according to the invention has a suspension which allows both a large stroke and stable movements of the undulated membrane. Moreover, the specific corrugation structure of the membrane allows excellent acoustical performance due to its excellent stiffness and light weight.

It is to be noted that EP-A 914 020 discloses a loudspeaker with a flat membrane which is provided with a ring-shaped supporting element to which a centering membrane is secured. The ring-shaped supporting element is provided at the flat membrane side opposite to the drive unit of the speaker. The supporting element extends around the middle axes of the speaker and serves to counteract tumbling of the flat membrane. Such a ring-shaped supporting element is not suitable for a membrane provided with a pattern of folds, as is the case in the loudspeaker according to the invention.

A preferred embodiment of the loudspeaker according to the invention has the characteristic feature that the inner circumferential edge and the outer circumferential edge of the membrane are substantially flat edges.

The loudspeaker according to this embodiment is provided with a membrane which is only undulated in an area extending between its substantially flat circumferential edges. Because of this measure, this loudspeaker is production-friendly as the circumferential edges are or are at least practically flat, whereby the connection of the membrane with the frame and the fixation of the membrane to the coil support can take place in conventional ways generally known for mounting flat membranes. This fixation of the flat inner circumferential edge of the membrane to the coil support can be realized by means of a suitable glue, as is common practice.

It is to be noted that the expression "substantially flat" has the meaning of flat or practically flat in this document. A deviation, if any, of flatness of the edges must be small as compared with the maximal depth of the folds.

Because of the specific corrugated structure applied in the membrane body of the loudspeaker according to the invention, the membrane is reinforced over its surface and has sufficient stiffness to be suitable as a shallow or flat membrane. The degree of undulations depends on the shape of the folds. In principle, the folds may have any shape, such as round or sharp. The pattern of folds is preferably regular, e.g. uniform, viewed in a circumferential direction.

A shallow loudspeaker provided with a membrane as described above has an excellent sound performance, due to its good behavior at and above the first break-up. In other words, also at and above the first break-up there is hardly distortion of the reproduced sound.

The folds preferably have a depth, measured from the membrane body, which smoothly decreases towards the substantially flat outer circumferential edge and/or the substantially flat inner circumferential edge of the membrane.

In a practical embodiment, the membrane body is a concave body, particularly a slightly concave body, the substantially flat inner circumferential edge and the substantially flat outer circumferential edge being in parallel planes. In this case, the membrane body is preferably a truncated slightly cone-shaped body. In general, the inner circumferential edge is circular; the outer circumferential edge may have a different shape, such as more or less elliptical or rectangular.

Another practical embodiment has the feature that the membrane body is a body whose inner circumferential edge, particularly the substantially flat inner circumferential edge, and the outer circumferential edge, particularly the substantially flat outer circumferential edge, are situated in substantially coinciding planes or zones.

It is practical to adhere the suspension means, particularly the spider, to the faces of the folds by means of an adhesive, which folds, as described above, are located in the area between the inner and outer edges of the membrane.

It is also practical to adhere the membrane to the movable part of the drive unit, particularly to its coil support. Existing suitable glues may be used for this purpose.

It is to be noted that the loudspeaker according to the invention is suitable for sound reproduction in hifi, home, automotive, TV and multimedia systems and particularly suitable for applications having very small build-in depths.

With regard to the claims, it is noted that various combinations of embodiments and features as described in the claims are possible within the scope of the invention.

BRIEF DESCRIPTION OF THE DRAWINGS

The invention will now be described in more detail, by way of example, with reference to the drawings, in which.

DETAILED DESCRIPTION

Figure 1:
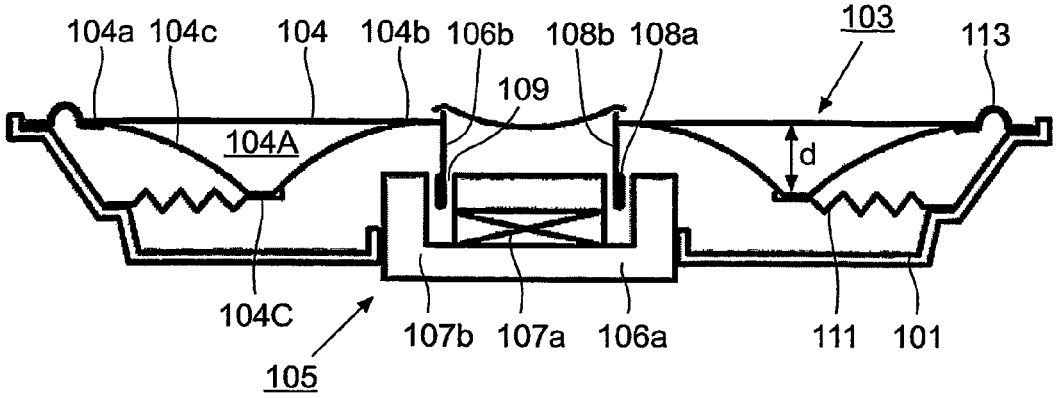
FIGS. 1 to 3 show diagrammatically in cross-sections three embodiments of the loudspeaker according to the invention.
Figure 2:
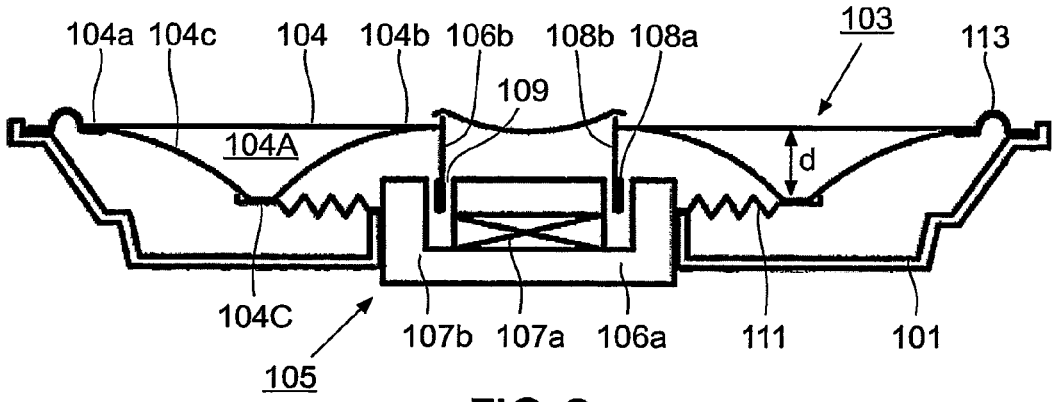
Figure 3:
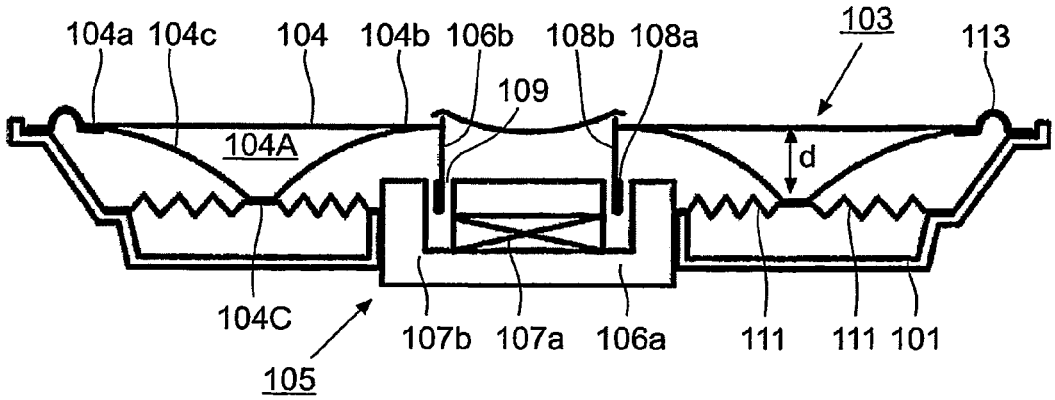

The loudspeakers depicted in FIGS. 1 to 3 are provided with a frame 101, a membrane 103 and an electromagnetic drive unit 105. In principle, the membrane 103 has a flat membrane body 104 provided with a flat outer circumferential edge 104*a* and a flat inner circumferential edge 104*b* and is provided with a pattern of radial folds 104*c*, which pattern extends over the surface of the membrane 104, viewed in circumferential direction. The folds 104*c* have a depth (d) which increases from the outer edge 104*a* towards a middle area 104A formed by a ring-shaped zone between the edges 104*a* and 104*b*, and from the inner edge 104*b* towards this area 104A, whereby the maximum depth (d) is located in the area 104A. The folds 104*c* are provided with faces 104C in the area 104A. The membrane body 104 may be made of e.g. paper, particularly reinforced paper. The drive unit 105 comprises a stationary part 106*a* and a movable, i.e. translatable, part 106*b*. The stationary part 106*a* is secured to the frame 101 and comprises a magnet system including a permanent magnet 107*a* and a magnetic yoke 107*b*, and the translatable part 106*b* comprises a coil system including a voice coil 108*a* and a coil former or support 108*b* on which the coil 108*a* is attached. The magnet system and the coil system magnetically cooperate with each other during use through an air gap 109. The coil support 108*b* is adhered to the inner circumferential edge 104*b* of the membrane 104 by means of a suitable glue, which may be a known glue.

The outer circumferential edge 104*a* of the membrane 104 is connected to the frame 101 by a resilient means 113, such as a roll-collar known per se and made of e.g. rubber or foam.

The membrane 104 is also connected to the frame 101 by way of a suspension means, particularly a spider 111, which is secured at its outer rim to the frame 101 and at its inner rim to the faces 104C of the folds 104*c*, preferably by means of a glue. In the embodiment depicted in FIG. 3, two spiders 111 have been applied.

Instead of the flat membrane body, a slightly conical membrane body may be used, without losing the characterizing advantages of the invention.

Figure 4:
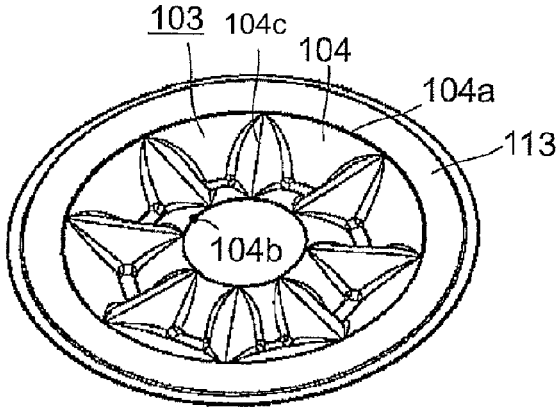
FIG. 4 is a diagrammatical top view of the membrane shown in FIG. 1.
Figure 5:
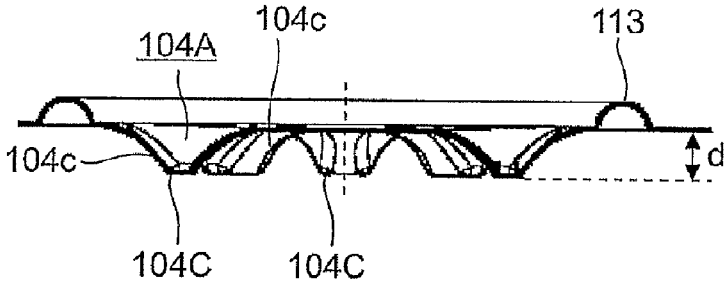
FIG. 5 is a diagrammatical cross-section of the membrane shown in FIG. 1.

The reference signs applied to the membrane depicted in FIGS. 4 and 5 are identical to the signs used in the description of the embodiments of FIGS. 1 to 3.

Figure 6:
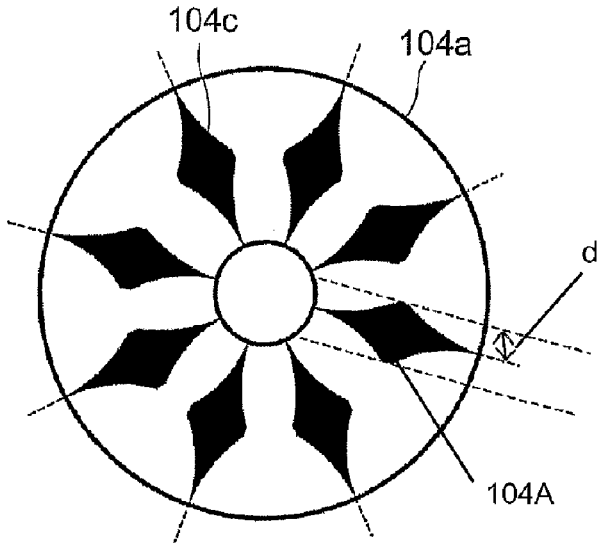
FIG. 6 is a fold/shape-fold distribution diagram of the membrane of the embodiment shown in FIG. 1.

The diagrammatical presentation in FIG. 6 displays the folds 104*c* and the shape of the membrane 103. The folds 104*c*, which are regularly distributed across the membrane face, have their maximum depth (d) in the middle area 104A.

Figure 7:
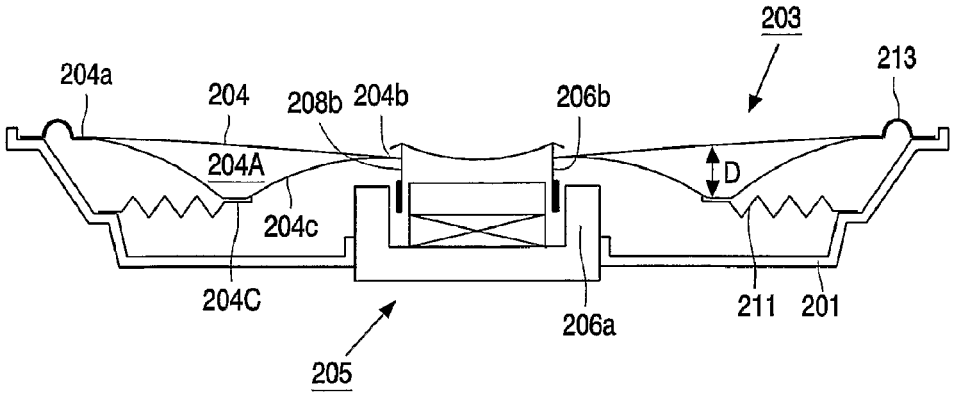
FIG. 7 shows diagrammatically in cross-sections a further embodiment of the loudspeaker according to the invention.
Figure 8:
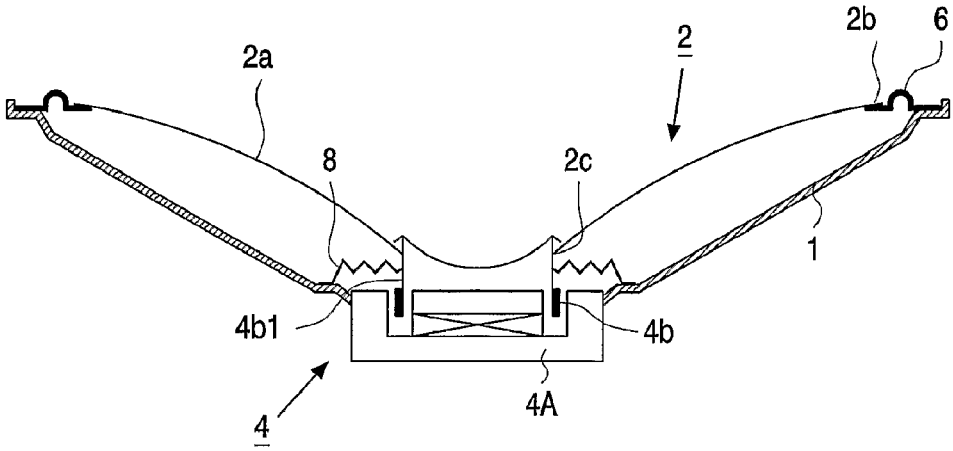
PRIOR ART FIG. 8
FIG. 8 shows diagrammatically a conventional loudspeaker.

The variant depicted in FIG. 7 is provided with a frame (201), a membrane (203) and a drive unit (205). The membrane has a flat outer circumferential edge (204*a*) suspended from the frame (201) and a flat inner circumferential edge (204*b*). The drive unit (205) has a stationary part (206*a*) secured to the frame (201) and a translatable part (206*b*) provided with a coil support (208*b*) secured to the inner circumferential edge (204*b*) of the membrane (203). The membrane (203) includes a slightly conical membrane body (204), whereby the outer circumferential edge (204*a*) and the inner circumferential edge (204*b*) are not situated in the same plane but in parallel planes. Viewed in a circumferential direction, the membrane body (204) has a pattern of folds (104*c*) radially extending between the inner circumferential edge (204*b*) and the outer circumferential edge (204*a*) of the membrane. Viewed from the membrane body (204) towards the drive unit (205) in a direction perpendicular to the membrane (203), the folds (204*c*) have a depth (D), which increases from the edges (206*a*, 206*b*) towards a middle area (204A) situated between both edges (206*a*, 206*b*). In this area (204A), the folds, or at least several folds, are provided with faces (204C). The membrane (203) is suspended from the frame (201) by way of a first suspension means in the form of a resilient ring-shaped element (213) known per se and a second suspension means in the form of a so-called spider (211) known per se. The ring-shaped element (213) is secured to the outer circumferential edge (204*a*) of the membrane (203) and to an edge portion of the frame (201). The spider (211) is secured to the faces (204C) of the membrane body (204) and to another portion of the frame (201).

It is to be noted that the disclosed embodiments are only given by way of example. Within the scope of the invention, it is possible to combine different features of embodiments to build a loudspeaker according to the invention. Moreover, within the scope of the invention, it is possible to vary on the examples given. For example, the regular pattern of folds may be replaced, if desired, by a non-regular pattern, or undulating inner and/or outer circumferential edges may be applied.

The invention claimed is:

1. A loudspeaker provided with a frame (101), a membrane (103) and a drive unit (105), the membrane having an outer circumferential edge suspended from the frame and an inner circumferential edge, the drive unit having a stationary part secured to the frame and a translatable part secured to the inner circumferential edge of the membrane, wherein the membrane includes a membrane body (104) which, viewed in a circumferential direction, has a pattern of folds (104*c*) radially extending between the inner circumferential edge and the outer circumferential edge of the membrane, which folds, viewed from the membrane body towards the driving unit in a direction substantially perpendicular to the membrane, have a depth (d) which increases from said edges towards an area (104A) situated between the inner circumferential edge and the outer circumferential edge, in which area the folds are provided with faces (104C), wherein a suspension means is provided which is secured to the frame and said faces.

2. A loudspeaker as claimed in claim 1, wherein the inner circumferential edge and the outer circumferential edge are substantially flat edges.

3. A loudspeaker as claimed in claim 1, wherein the inner circumferential edge and the outer circumferential edge of the membrane are situated in substantially coinciding planes or zones.

4. A loudspeaker as claimed in claim 2, wherein the membrane body is a slightly concave body, the substantially flat inner circumferential edge and the substantially flat outer circumferential edge being situated in parallel planes.

5. A loudspeaker as claimed in claim 1, wherein the suspension means is a spider.

6. A loudspeaker as claimed in claim 2, wherein the substantially flat inner circumferential edge of the membrane is secured to a coil support of the translatable part of the driving unit.

7. A loudspeaker as claimed in claim 2, wherein the folds have a depth which, measured from the membrane body, smoothly decreases from the area in which the folds are provided with faces towards the substantially flat outer circumferential edge of the membrane.

8. A loudspeaker as claimed in claim 2, wherein the folds have a depth which, measured from the membrane body, smoothly decreases from the area in which the folds are provided with faces towards the substantially flat inner circumferential edge of the membrane.

9. A loudspeaker as claimed in claim 1, wherein the pattern of folds is a regular pattern, viewed in a circumferential direction and/or radial direction.

* * * * *